United States Patent [19]

Buckley et al.

[11] 4,028,690

[45] June 7, 1977

[54] INTRUDER DETECTION DEVICE

[75] Inventors: Norman Ian Buckley; Edward Wilson, both of Blackburn, England

[73] Assignee: Shorrock Developments Limited, Blackburn, England

[22] Filed: Jan. 29, 1976

[21] Appl. No.: 653,537

[52] U.S. Cl. ..... 340/258 B; 343/5 PD; 340/258 D

[51] Int. Cl.[2] ..... G08B 13/24

[58] Field of Search ..... 340/258 B, 258 D; 343/5 PD

[56] References Cited

UNITED STATES PATENTS

| | | | |
|---|---|---|---|
| 3,331,065 | 7/1967 | McDonald | 343/5 PD |
| 3,541,551 | 11/1970 | Bystrom, Jr. et al. | 340/258 B |
| 3,879,719 | 4/1975 | Buckley et al. | 340/258 B |
| 3,967,283 | 6/1976 | Clark et al. | 343/5 PD |

*Primary Examiner*—Glen R. Swann, III
*Attorney, Agent, or Firm*—Ross, Ross & Flavin

[57] ABSTRACT

To prevent unintentional alarm initiation in an intruder detection system of the kind in which a transmitter emits radio waves across an area to be monitored and a receiver senses changes in the resultant signal, which initiation might otherwise occur as a result of environmental changes or natural causes such as the entry of a small animal into the monitored area, a receiver for such a system is adapted to sense the received signal at predetermined intervals of time and only to cause alarm initiation in the event that the change occurring in any one of said predetermined intervals exceeds a predetermined amount. Such an arrangement serves, therefore, to compensate automatically for changes, in the received signal, arising from environmental changes.

5 Claims, 2 Drawing Figures

INTRUDER DETECTION DEVICE

FIELD OF THE INVENTION

The present invention relates to intruder detection systems of the kind which make use of a beam of microwave energy.

BRIEF DISCUSSION OF PRIOR ART

It is known to generate a beam of radiation from an aerial, the emission being suitably modulated preferably at an audio frequency, and to receive the transmission by means of a suitable receiver. THe transmitter and receiver are spaced a suitable distance apart and the receiver output level is monitored to detect changes in received signal level indicative of the presence of an intruder in the area between the transmitter and receiver.

As such intruder detection systems are frequently called on to operate in an external environment, changes in the received signal level due to natural causes, such as rain, must be discriminated against if the system is to preserve its integrity. In general, signal level changes due to natural causes are relatively slow changes and may be removed by a slow acting automatic gain control.

DISCUSSION OF THE INVENTION

According to the present invention, a receiver for this type of intruder detection system comprises an aerial, a radio frequency detector, signal processing means adapted to provide a D.C. signal the level of which is proportional to the amplitude of the received signal, sampling means adapted to sample said D.C. signal level at predetermined intervals of time, and detector means adapted to detect any change in said D.C. level greater than a predetermined amount during any one of the predetermined intervals, and in the event of detection of such a change, to initiate an alarm.

BRIEF RESUMEE OF THE DRAWINGS

Figure 1:
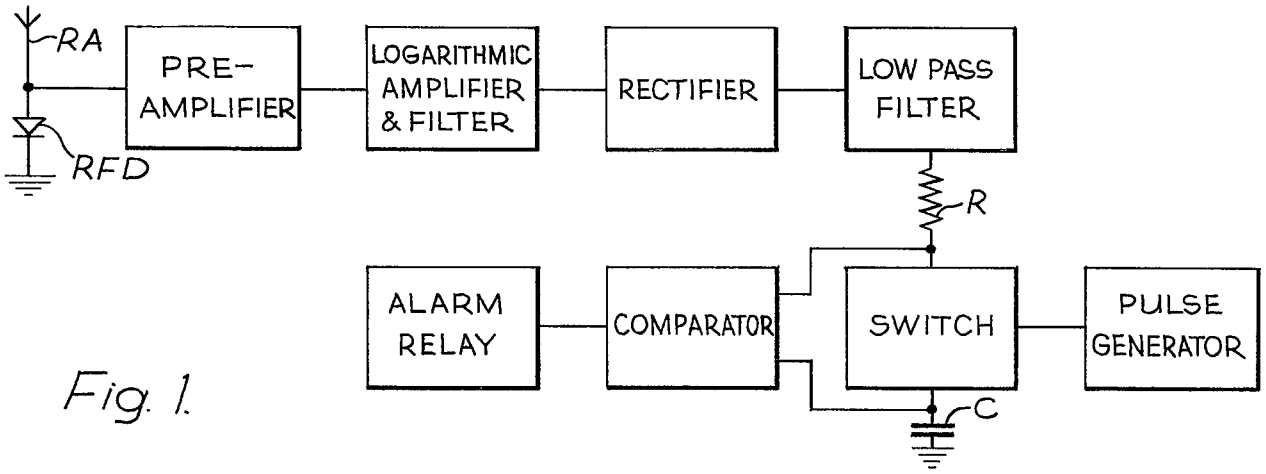
Figure 2:
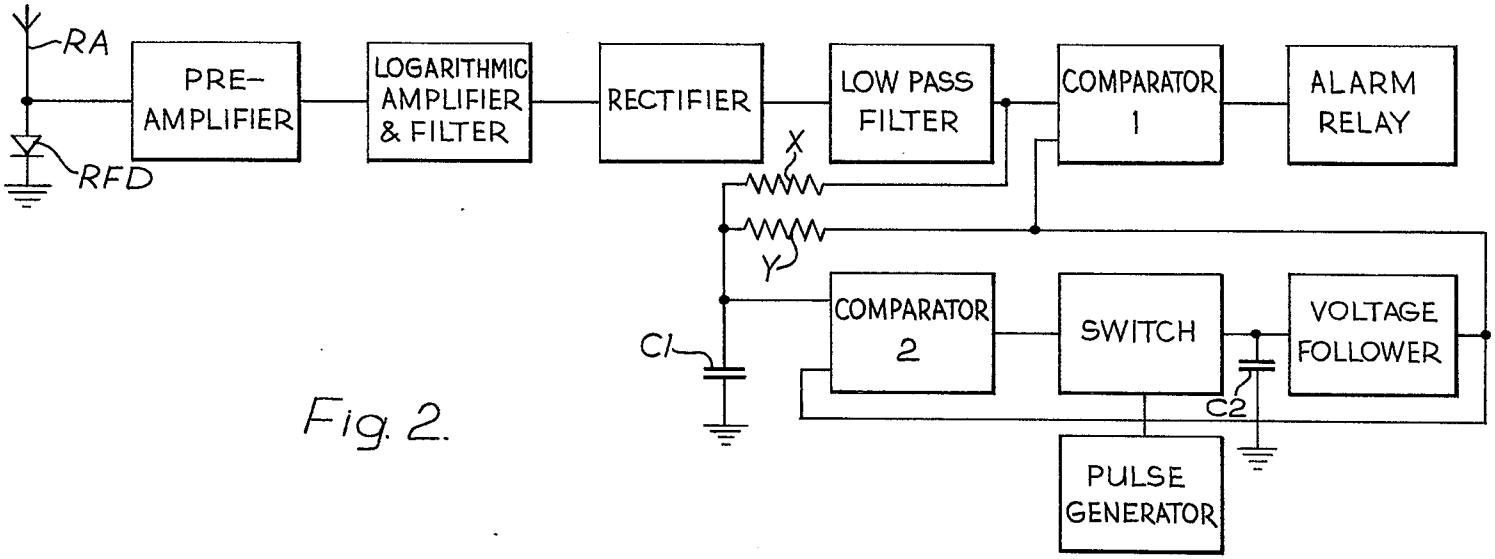

The invention will be described further, by way of example, with reference to the accompanying drawings, in which:

FIG. 1 is a block diagram illustrating a first embodiment of the receiver of the invention; and FIG. 2 is a block diagram illustrating a second embodiment of the receiver of the invention.

SPECIFIC DESCRIPTION OF THE ILLUSTRATED EMBODIMENTS

FIG. 1

Referring firstly to FIG. 1 of the drawings, this illustrates a receiver for an intruder detection system of the kind employing a transmitter to produce a modulated radio frequency emission, the receiver having means for monitoring its output level to detect changes in received signal level indicative of the presence of an intruder in the area between the transmitter and the receiver.

In the arrangement of FIG. 1, the audio frequency modulated microwave signal received by receiver aerial RA is detected by a radio frequency detector RFD which may typically be a Schottky barrier diode. The audio frequency modulation is extracted and amplified by a preamplifier. The signal is then passed to a logarithmic amplifier and filter which provides further gain, and which, due to the logarithmic characteristics of the amplifier, is capable of handling a wide range of input signal levels which may occur in practice. The filter in this component is of the pass band type centred around a selected modulation frequency, which may typically be 1 kHz, and its purpose is to restrict amplification to the modulation frequency, thus enhancing the signal to noise ratio.

The amplified audio frequency signal is then passed to a rectifier wherein it is rectified to provide a D.C. signal proportional to the input signal level. The resulting D.C. signal is then fed via a low pass filter to reject any fast transient signals which are of no interest. The low pass filter output is then supplied to an R-C circuit in which is disposed a switch controlled by a pulse generator. The D.C. signal is applied via the resistor R of the R-C circuit to one input of a comparator the other input of which is taken from the R-C between the switch and the capacitor thereof. The pulse generator operates the switch in such a manner that the resistor and capacitor of the R-C circuit are connected in series only for brief intervals of time. The duty cycle of the pulse generator is therefore low.

The comparator is arranged to respond to either an increase or decrease in the D.C. signal level, and in its static state the inputs to the comparator will be the same. Should any change in D.C. input signal level occur, this will be immediately seen by the comparator which may or may not give an output according to the extent of the signal change. If the amplitude change is sufficient to cause a comparator output, then this output de-energises an alarm relay whose contacts may be used to generate an alarm as desired. However, if the amplitude change is insufficient to cause the comparator output, on closure of the switch under the control of the pulse generator, the capacitor C will endeavour to recharge to the altered input signal level via the resistor R, the absolute amount of change being determined by the RC value, and the length of time for which the switch is closed. This change of voltage reduces the differential input to the comparator and after sufficient pulses from the pulse generator, the input levels to both inputs of the comparator will equate. The rapidity with which an input signal change is compensated is a function of the RC value, the length of time for which the switch is closed and the frequency of switch closure.

As a consequence, permanent changes in signal level insufficient to cause a comparator output will be effectively removed over a period of time. Such small changes can be caused by slow alterations of the transmitted signal, due to environmental reasons, such as temperature change, or weather conditions altering the attenuation of the signal path. However, signal changed caused by intrusion of a human being into the protected zone consisting of the area between the transmitter and the receiver tend to be of greater amplitude and of shorter duration than those occurring due to environmental causes.

FIG. 2

In the alternative embodiment shown in FIG. 2, the circuitry up to the low pass filter providing the D.C. output signal is the same as in FIG. 1, and therefore need not be further described. In this embodiment, however, the input signal is applied to one input of a first comparator, comparator 1, and also to an R-C circuit comprising resistor X and capacitor C1, the output of which is connected to one input of a second comparator, comparator 2. The second comparator's output is connected via a switch operated by a pulse generator to a storage capacitor C2 whose state of charge is applied, via a voltage follower to the second inputs of comparator 1 and comparator 2 and also via a further resistor Y to capacitor C1 of the R-C circuit.

If in the operation of this embodiment the input signal level remains constant, then the D.C. voltages applied to all of the comparator inputs will be equal. Should the input signal level change, then an imbalance will occur in both comparators. Should the imbalance in comparator 1 be large enough for it to give an output, then an alarm relay is de-energised and its contacts may be used to generate an alarm as desired. Should the imbalance be insufficient for the first comparator to give an output, then the state of charge of the capacitor C1 will alter according to the input voltage via resistor X and also the previous voltage stored by the storage capacitor C2 via the voltage follower and resistor Y. Hence, the voltage on the capacitor C1 will be a function of the new input voltage level and the ratio of resistors X and Y. When the pulse generator operates to close the switch, the storage capacitor C2 will attain a state of charge corresponding to that of capacitor C1 which in turn, via the voltage follower, will reduce the voltage differential on comparator 1 and also the voltage differential between the input signal level and the new value attained by the storage capacitor C2. Capacitor C1 now alters its state of charge, via resistors X and Y, to a new value closer to the input signal level, and assuming no further change in input signal level, on the next operation of the pulse generator, the same sequence occurs, further reducing the imbalance. The sequence cycle repeats until the imbalance on comparator 1 is effectively zero, or, of course, until there is sufficient change in the input signal to cause the comparator 1 to actuate the alarm relay.

We claim:

1. A receiver, for an intruder detection system of the kind employing a transmitter to produce a modulated radio frequency emission which is received by a receiver the output level of which is monitored to detect changes in received signal level indicative of the presence of an intruder in the area between the transmitter and the receiver, the receiver comprising: an aerial, a radio frequency detector to demodulate the signal received by the aerial, signal processing means adapted to provide a D.C. signal the level of which is proportional to the amplitude of the demodulated signal, sampling means adapted to sample the level of said D.C. signal at predetermined intervals of time, detector means connected to the signal processing means via the sampling means to detect a change in the D.C. level greater than a predetermined amount during any one of the predetermined intervals and, in the event of detection of such a change, to initiate an alarm, the sampling means including a switch adapted to open and close at predetermined intervals for providing at each side of the switch potentials representative respectively of the D.C. signal and a datum derived from the level of the D.C. signal during a preceding closed interval of the switch.

2. A receiver as claimed in claim 1 wherein the detector means comprises a comparator which receives said potentials, and provides an alarm signal if there is a predetermined difference in their levels.

3. A receiver as claimed in claim 1 wherein the sampling means comprises an R-C circuit receiving the D.C. signal which provides also a first input for a first comparator, the R-C circuit providing a reduced potential as a first input for a second comparator whose output is connected by a switch adapted to open and close at predetermined intervals to a storage capacitor which provides second inputs for the two comparators and is connected, via a respective resistor, to the R-C circuit, the first comparator serving as the detector means.

4. A receiver as claimed in claim 3 wherein the second comparator is connected to the second input of the first comparator by way of a voltage follower which prevents undesired discharge of the storage capacitor.

5. A receiver as claimed in claim 4 wherein the switch is actuated by a pulse generator.

* * * * *